US008066144B2

(12) United States Patent
McNamara et al.

(10) Patent No.: US 8,066,144 B2
(45) Date of Patent: Nov. 29, 2011

(54) WASTE CAN

(75) Inventors: David McNamara, Huntersville, NC (US); Ian Westad Cunningham, Huntersville, NC (US); Joseph Dugan Musser, Huntersville, NC (US); Clayton Kirschner, Charlotte, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 382 days.

(21) Appl. No.: 12/277,730

(22) Filed: Nov. 25, 2008

(65) Prior Publication Data

US 2009/0173741 A1 Jul. 9, 2009

Related U.S. Application Data

(60) Provisional application No. 61/004,486, filed on Nov. 27, 2007.

(51) Int. Cl.
*B65D 35/14* (2006.01)

(52) U.S. Cl. ..... 220/495.11; 220/495.01; 220/495.06; 220/495.08; 220/908.1

(58) Field of Classification Search ..... 220/495.01, 220/495.06, 495.08, 495.11, 908.1
See application file for complete search history.

(56) References Cited

U.S. PATENT DOCUMENTS

| | | | | |
|---|---|---|---|---|
| 4,753,367 | A | 6/1988 | Miller et al. | |
| 4,765,579 | A | 8/1988 | Robbins, III et al. | |
| 4,776,478 | A | 10/1988 | Miller et al. | |
| 5,242,074 | A | 9/1993 | Conaway et al. | |
| 5,310,078 | A | 5/1994 | Strawder | |
| 5,628,424 | A | 5/1997 | Gola | |
| 5,735,495 | A | 4/1998 | Kubota | |
| 5,803,300 | A | 9/1998 | DeMars | |
| 6,959,833 | B1 | 11/2005 | Paul | |
| 2004/0074907 | A1 * | 4/2004 | Gardner | 220/495.11 |
| 2004/0238553 | A1 | 12/2004 | Lane et al. | |
| 2005/0205579 | A1 | 9/2005 | Buchalter et al. | |

OTHER PUBLICATIONS

HMS Mfg.; www.hmsmfg.com/products/housewares/2158.htm; 1 page.
Sterilite; www.sterilite.com/Category.html?Section=Household &ProductCategory=55; 1 page.
International Preliminary Report on Patentability from The International Bureau of WIPO, PCT/US2008/084874, Jun. 1, 2010.
International Preliminary Report on Patentability from The International Bureau of WIPO, PCT/US2008/084881, Jun. 1, 2010.
PCT International Search Report dated Jan. 28, 2009.
PCT International Search Report dated Jan. 29, 2009.

* cited by examiner

*Primary Examiner* — Anthony Stashick
*Assistant Examiner* — Elizabeth Volz
(74) *Attorney, Agent, or Firm* — Dennis J. Williamson; Moore & Van Allen, PLLC

(57) ABSTRACT

A waste can comprises a receptacle having a rim with at least one bag lock located on the rim. The bag lock has a first portion defining a cavity and a second portion movable with respect to the first portion between a first position where it is locked to the first portion and a second position where it is spaced from the first portion. The second portion locks a trash bag in the cavity when in the first position.

11 Claims, 6 Drawing Sheets

WASTE CAN

This application claims benefit of priority under 35 U.S.C. §119(e) to the filing date of to U.S. Provisional Application No. 61/004,486, as filed on Nov. 27, 2007, which is incorporated herein by reference in its entirety.

FIELD OF THE INVENTION

The invention relates to mechanisms for retaining a trash bag or bag liner inside of a waste can.

BACKGROUND OF THE INVENTION

Waste cans for waste disposal are known that comprise a container having an open top end into which waste is deposited. The waste cans may be made of plastic, metal or other materials and may include a lid that covers the open top end. To facilitate clean up, disposable trash bags or bag liners made of a thin flexible material are inserted into and line the waste can such that waste is deposited into the trash bag or bag liner. The trash bag or bag liner contains the waste and can be removed from the container to dispose of the waste.

SUMMARY OF THE INVENTION

A waste can comprises a receptacle having a rim with at least one bag lock located on the rim. The bag lock has a base defining a cavity and a locking member movable with respect to the base between a first position where it is locked to the base and a second position where it is spaced away from the base. The locking member secures a trash bag in the cavity when in the first position.

DETAILED DESCRIPTION OF PREFERRED EMBODIMENTS OF THE INVENTION

Figure 1:
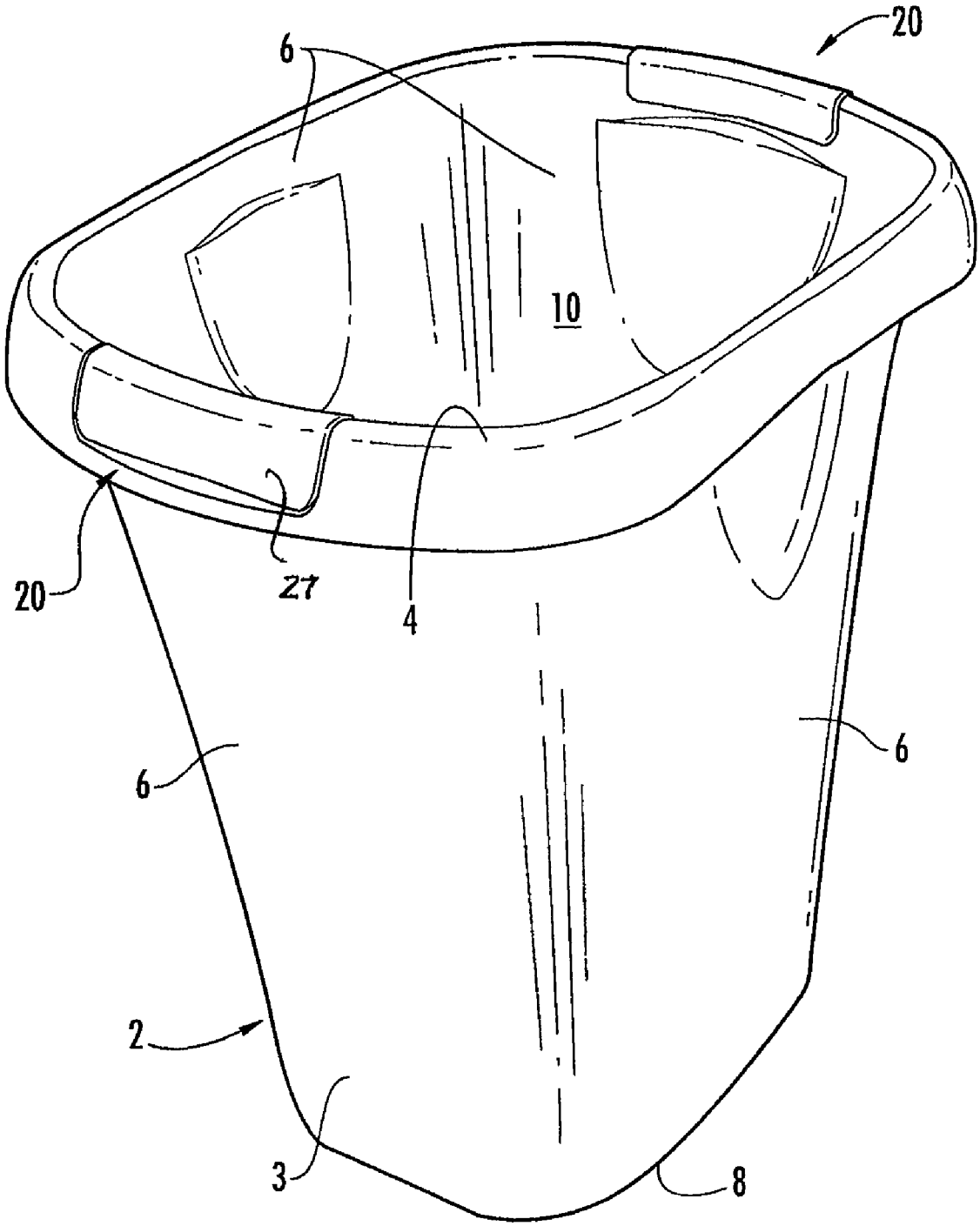
FIG. 1 is a perspective view of an embodiment of the waste container of the Invention showing the bag locking mechanism in the closed position.
Figure 2:
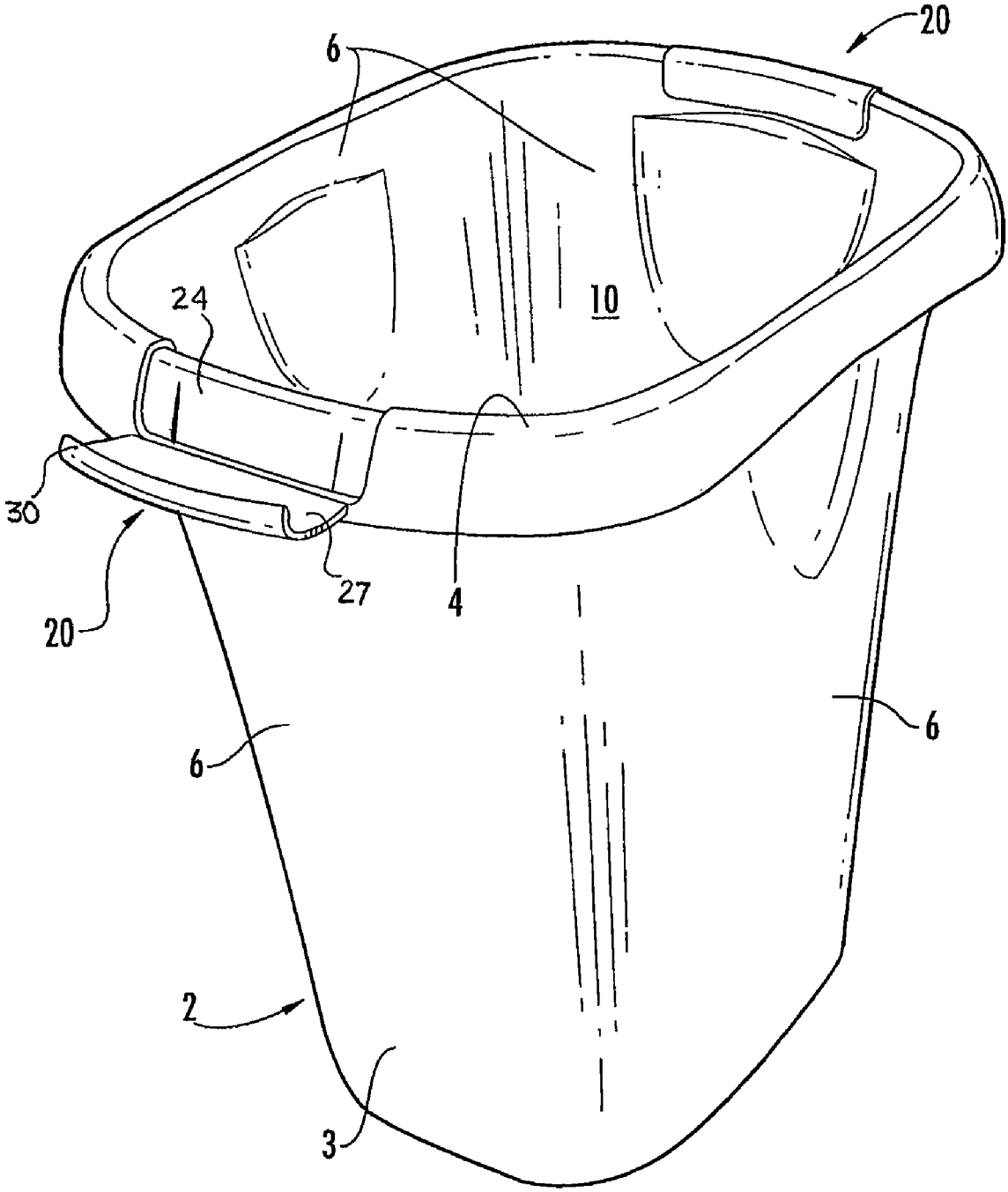
FIG. 2 is a perspective view of the waste container of FIG. 1 showing the bag locking mechanism in the open position.

Referring to the Figures, an embodiment of a waste can is shown that includes a waste can 2 comprising a receptacle 3 having generally upwardly extending sides 6 and a bottom 8 defining an interior space 10 for receiving trash, garbage or other waste. The waste can 2 may be made of injection molded poly-propylene. The waste can 2 includes a top rim 4 defining the opening into the interior space 10. Bag locks 20 are located at spaced intervals along the rim 4. In the illustrated embodiment two bag locks 20 are provided located opposite to one another although a greater or fewer number of bag locks may be used and the locations of the bag locks 20 around the rim 4 may vary.

Figure 4:
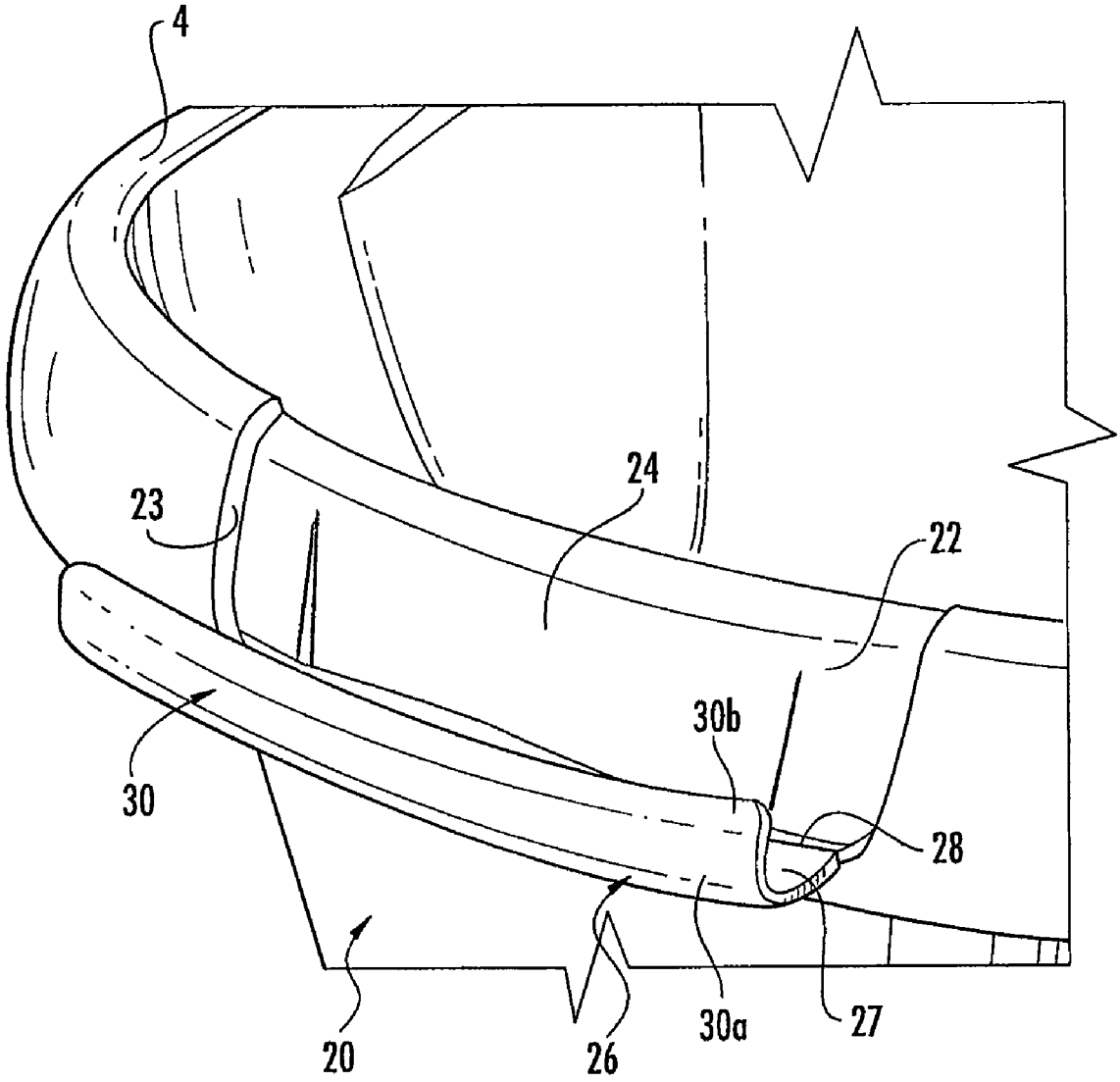
FIGS. 4 and 6 are detailed perspective views of the bag locking mechanism in the open position.

Referring to FIG. 4, the rim 4 is formed with recessed areas 23 for receiving the back locks 20. Each bag lock 20 includes a base 22 that fits in the recessed areas 23 and defines a cavity 24 for receiving a portion of the upper edge of a trash bag. In the illustrated embodiment the base 22 defines a downwardly facing U-shaped channel that fits over the top of recessed area

23. A locking member 26 is pivoted to the base 22 such that the locking member 26 can close over the base 22. In the illustrated embodiment the locking member 26 is pivoted to the base 22 at a living hinge 28 that flexes to allow the locking member 26 to close and open relative to the base 22. The living hinge is located at the bottom of the base 22 such that the locking member opens toward the top of the waste container at the top edge of rim 4. With the use of a living hinge 28 the bag lock 20 can be molded of a single piece of plastic material. While a living hinge is shown, the hinge may comprise a separate mechanical hinge. The bag lock 20 may be formed on the waste container 3 during the molding process of the waste container 3 or the waste container 3 and bag lock 20 may be formed in separate manufacturing operations and secured to one another by adhesive, sonic welding, mechanical attachment, or the like.

The locking member 26 includes a side wall 27 that is connected to the base at the hinge 28 and substantially covers the outer surface and cavity 24 of the base. A lip 30 extends from the side wall 27 remote from the hinge 28 that snap-fits to the base 22 to lock the locking member 26 to the base 22 in the closed position. The lip 30 is formed with a first portion 30*a* that extends over the top edge of base 22 and a second portion 30*b* that extends over a portion of the back side of base 22 opposite to cavity 24 to hold the locking member 26 in the closed position. To close the bag lock 20, the locking member 26 is pushed toward the base 22 where the lip 30 contacts the base 22 such that it flexes or is deformed enough to move over the top of the base 22. When the lip 30 clears the top edge of the base 22 the resiliency of the material of the locking member 20 forces the lip 30 into tight engagement with the base 22. The second portion 30*b* of lip 30 engages the back surface of the base 22 to retain the locking member 26 in the closed position.

Figure 3:
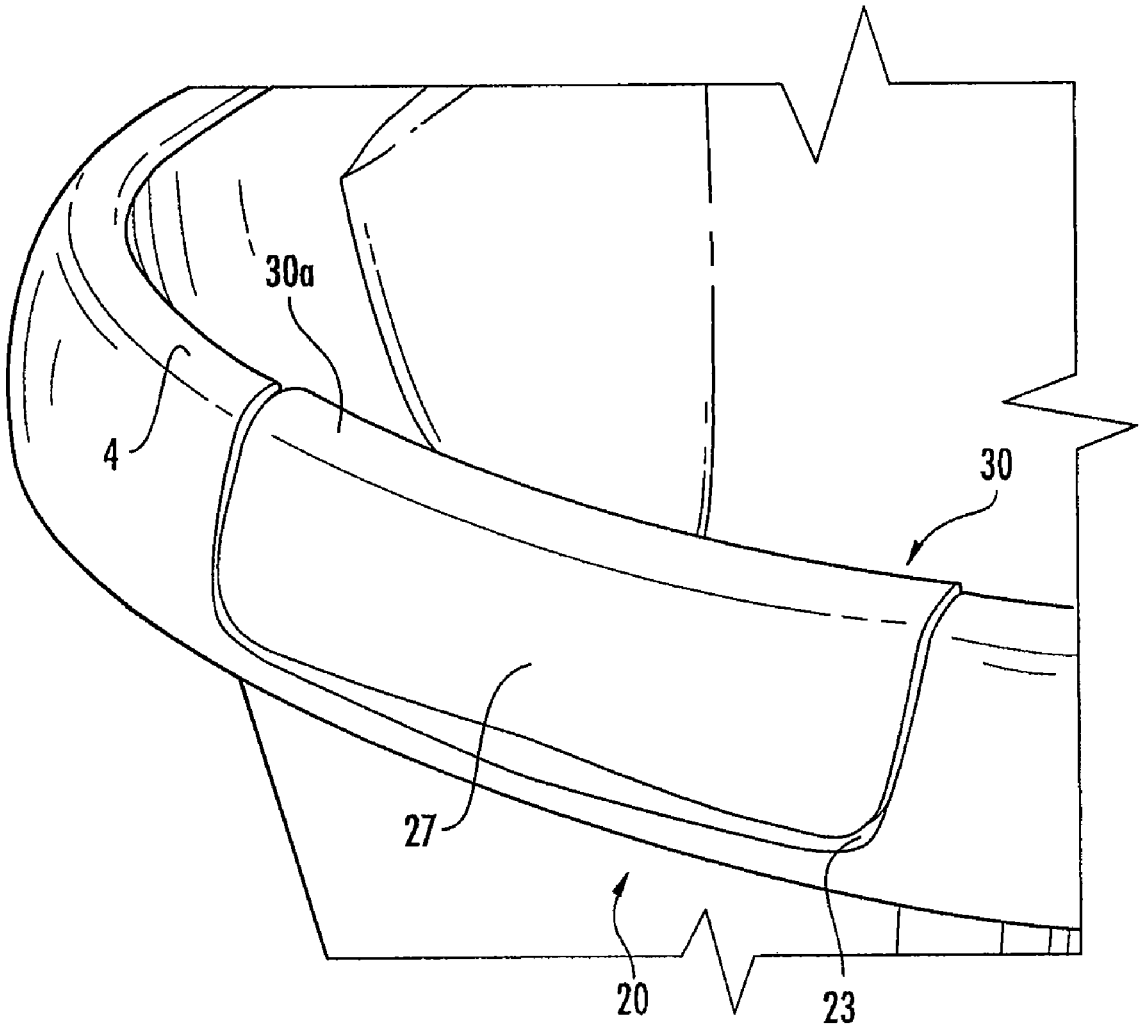
FIGS. 3 and 5 are detailed perspective views of the bag locking mechanism in the closed position.
Figure 5:
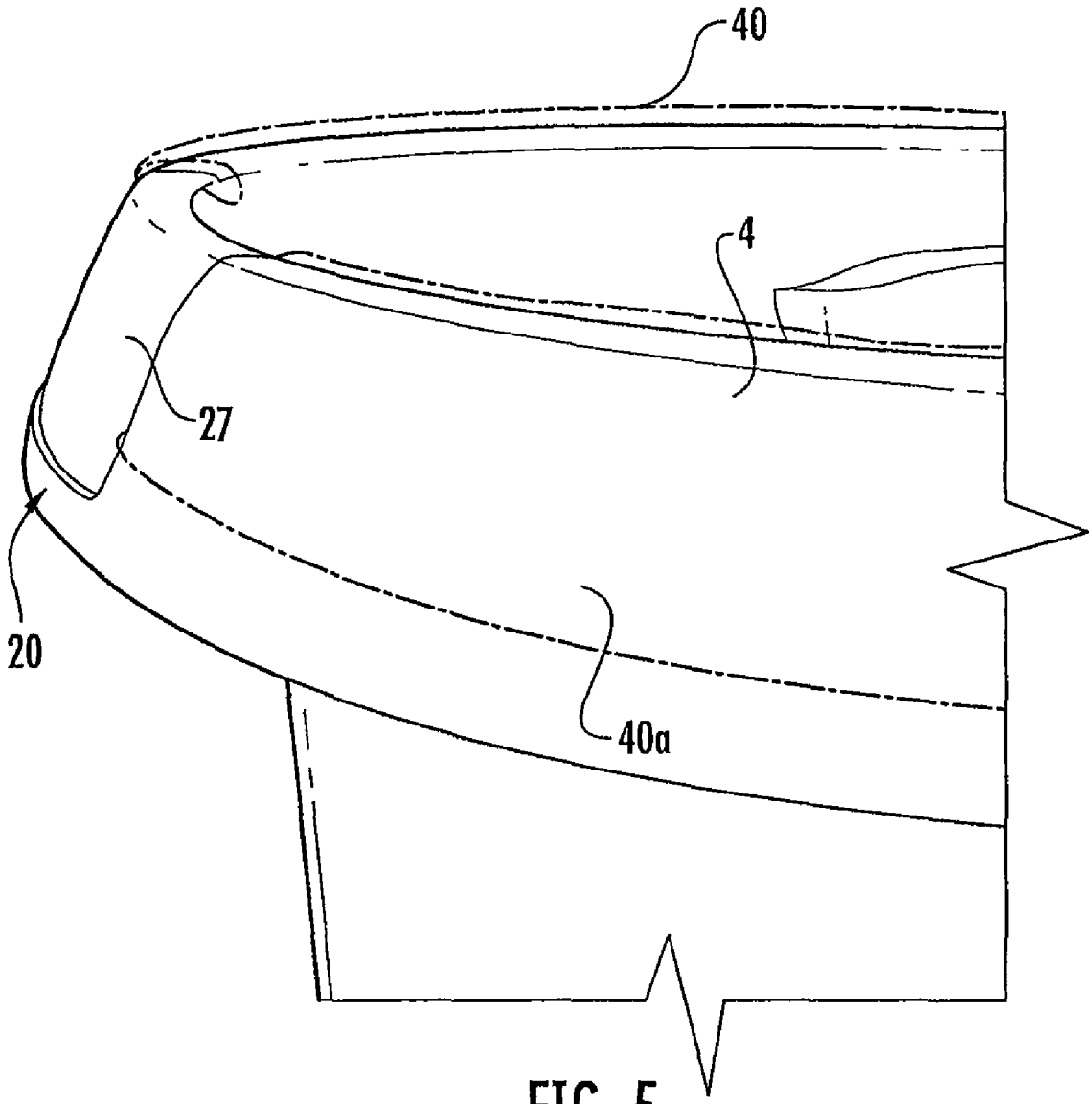
Figure 6:
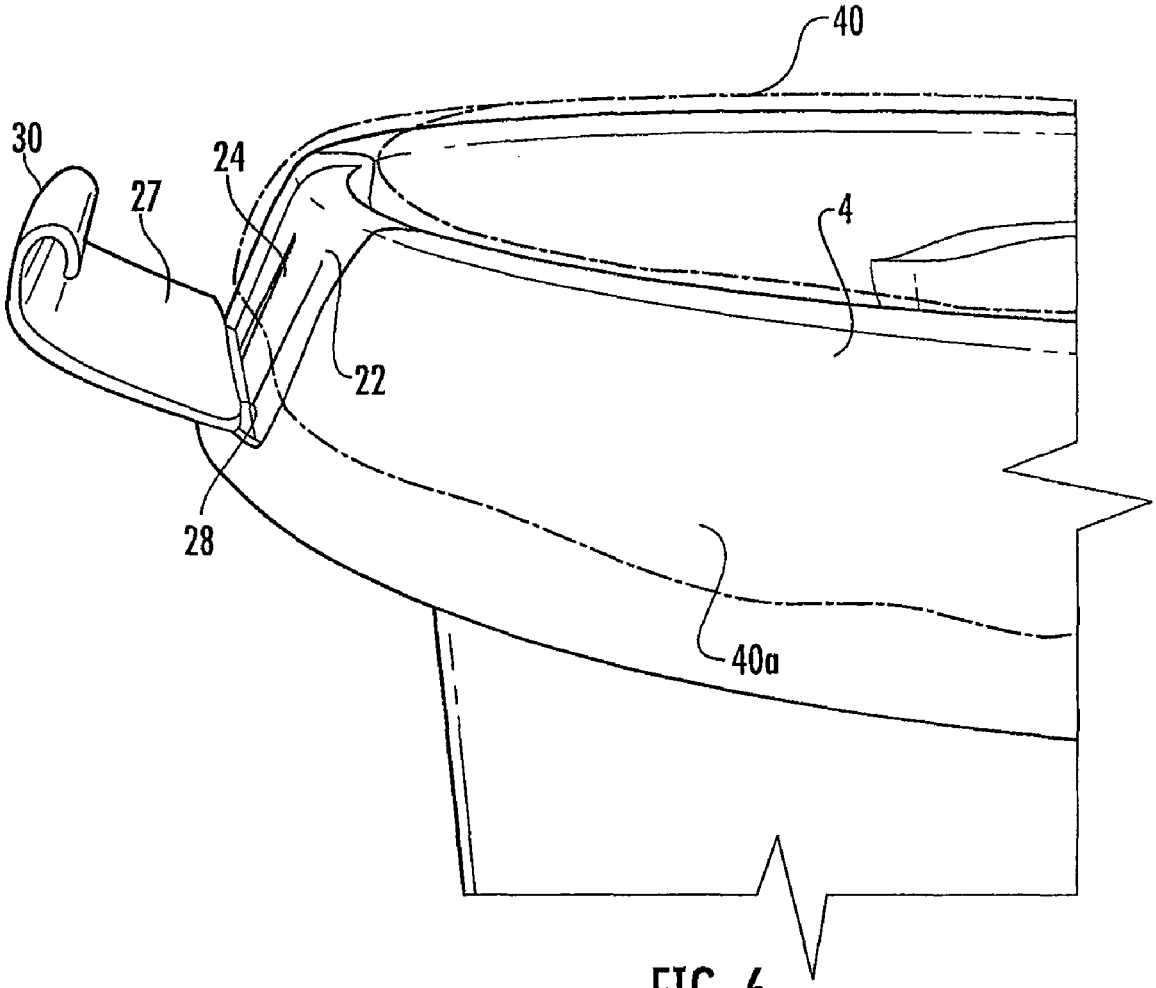

To open the bag lock 20 to remove the bag liner, the locking member 26 can flex slightly to allow the lip 30 to be disengaged from the base 22 such that the locking member can be moved from the closed position of FIGS. 3 and 5 to the open position of FIGS. 4 and 6. In the illustrated embodiment the locking member 26 flexes to effect the opening and closing of the bag lock, however, the base 22 could also flex slightly to effect the opening and closing of the bag lock.

In use, a trash bag or trash can liner 40 is inserted into the interior space 10 of waste can 2 and the upper open edge 40*a* of the trash bag/liner is draped over the rim 4 as shown in FIG. 6. The open upper edge 40*a* of the trash bag/liner is also positioned over the base 22. The locking member 26 is closed against base 22 to trap the upper edge of the bag in the bag lock 20 and maintain the position of the bag in the waste can 2 as shown in FIG. 5. Lip 30 engages the top edge of base 22 to lock the locking member 26 in position against the base. If the open edge 40*a* of trash bag or liner 40 is larger than the container 3, the bag or liner material at the open upper edge of the bag can be gathered and pushed into the cavity 24 such that when the locking member 26 is closed on the base 22 excess bag material is hidden from sight. This feature also allows the upper edge of the bag to be tightly cinched around the rim 4 of the receptacle 3.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A waste can comprising:

a receptacle having a rim defining a top of the receptacle that defines an opening into said receptacle;

at least one bag lock located on said rim, said bag lock having a base that forms part of the rim and that defines a cavity and a locking member movable with respect to the base between a first position where the locking member is locked to the base and a second position where the locking member is open from said base, said locking member securing a trash bag to the rim when in the first position;

wherein said base and said locking member are connected by a hinge, said hinge being located toward a bottom of the base such that the locking member opens toward the top of the receptacle;

said locking member including a lip remote from the hinge, said lip snap-fits to a top edge of the base to lock the locking member to the base in the first position.

2. The waste can of claim 1 wherein said receptacle is molded plastic.

3. The waste can of claim 2 wherein said bag lock is molded plastic and is formed integrally with said rim.

4. The waste can of claim 1 wherein said hinge is a living hinge.

5. The waste can of claim 4 wherein at least two bag locks are provided.

6. The waste can of claim 1 wherein the locking member deforms as it moves to said first position.

7. The waste can of claim 1 wherein the locking member includes a side wall that is connected to the base at the hinge, said side wall substantially covering the cavity.

8. The waste can of claim 1 wherein the lip is formed with a first portion that extends over the top edge of the base and a second portion that extends over a portion of an opposite side of the base to hold the locking member in the first position.

9. The waste can of claim 1 wherein the locking member contacts the base such that it flexes and moves over the top edge of the base.

10. The waste can of claim 9 wherein the resiliency of a material of the locking member forces the lip into tight engagement with the base.

11. A waste can comprising:

a receptacle having a rim defining an opening into said receptacle;

at least one bag lock located on said rim, said bag lock having a base defining a cavity and a locking member movable with respect to the base between a first position where the locking member is locked to the base and covers the cavity and a second position where the locking member is open from said base, said locking member securing a trash bag to the rim when in the first position and said cavity being dimensioned such that a liner material may be gathered and pushed into the cavity and covered by the locking member;

wherein said base and said locking member are connected by a hinge, said hinge being located toward a bottom of the base such that the locking member opens toward the top of the receptacle;

said locking member including a lip remote from the hinge, said lip snap-fits to the base to lock the locking member to the base in the first position.

* * * * *